United States Patent [19]

Hallum et al.

[11] Patent Number: 4,909,752

[45] Date of Patent: Mar. 20, 1990

[54] CIRCUIT CARD RETAINER

[75] Inventors: Donald W. Hallum, Glendale; George N. Gray, Jr., Phoenix, both of Ariz.

[73] Assignee: Honeywell, Inc., Minneapolis, Minn.

[21] Appl. No.: 331,215

[22] Filed: Mar. 31, 1989

[51] Int. Cl.[4] ..... H01R 13/631

[52] U.S. Cl. ..... 439/325; 361/388; 439/59

[58] Field of Search ..... 361/386, 387, 388; 439/59, 259, 260, 296, 325, 327, 329, 345, 346, 347, 359, 362, 369, 60, 61, 62; 165/80.1, 80.2, 80.3

[56] References Cited

U.S. PATENT DOCUMENTS 4,775,260 10/1988 Kecmer ..... 439/327 X
4,823,951 4/1989 Colomina ..... 439/59 X

OTHER PUBLICATIONS

Rexnord, Inc., "New Product Bulletin", release 87-2, Jul. 1987, 5 sheets, Rexnord, Inc., 601 Route 46 West, Hasbrouck Heights, NJ, 07604.

*Primary Examiner*—Eugene F. Desmond
*Assistant Examiner*—Walter G. Hanchuk
*Attorney, Agent, or Firm*—A. A. Sapelli; D. Lenkszus; A. Medved

[57] ABSTRACT

A combination wedge-lock type circuit card retainer and guide slot for use in an electronic chassis. The combination including an elongated base member having a circuit card guide wall formed along one side. One end of the base member has a fixed wedge formed thereon spaced from and facing the guide wall. A support aligned with the fixed wedge is formed adjacent the other end of the base member and it also is spaced from the guide wall. The combination retainer also includes a shaft having a head end and a thread end. The shaft extends through the fixed wedge with its thread end engaged in the support. An end wedge is threaded onto the shaft adjacent the thread end with a center wedge mounted on the shaft between the fixed and end wedges. The center wedge is provided with a spring that is grounded on the base member for biasing the center wedge into engagement and alignment with the fixed and the end wedges. The aligned wedges together with the guide wall forming a circuit card channel or slot. The combination retainer is adapted for mounting to a wall of the electronic chassis.

5 Claims, 3 Drawing Sheets

CIRCUIT CARD RETAINER

BACKGROUND AND SUMMARY

This invention relates to wedge-lock type circuit card retainers and more particularly to a combination of wedge-lock type circuit card retainer and a circuit card retainer slot for mounting into an electronic chassis.

Some conventional wedge-lock type circuit card retainers such as those available from Rexnord Inc. of Hasbrouck, N.J. are designed for riveting directly to the circuit card and the circuit card with the assembled retainer fixed thereon are inserted in retainer slot or guide member fastened to the electronic chassis.

These conventional retainers include an elongated shaft-like driver member having a head end provided with a hex, slot or cross type recess for mating engagement with an appropriate tool for manipulation of the driver member. The opposite end of the driver member includes a threaded section onto which an end wedge or cam member is adapted to be threadably mounted. A driver wedge or cam member having an aperture sized to provide a clearance fit for the driver is adapted for mounting on the driver adjacent the head end. A middle wedge or cam member is adapted to be mounted on the driver member intermediate the driver cam member and the end cam member. The middle cam member is provided with a channel which allows free axial and lateral movement of the driver member therein. The middle cam member is adapted to fixed to the circuit card by rivets or screws and is fitted with an alignment leaf spring. The opposite ends of the leaf spring extended beyond the middle cam member and engage with the driver cam member and the end cam member for retaining both of these cam members in alignment with the middle cam member in a fully assembled retainer.

In a fully assembled retainer clockwise rotation of the drive member will drive the camming surfaces of both the driver cam member and the end cam member against corresponding cam surfaces on the fixed middle cam member. Thereby forcing the end and driver cam member in a lateral direction away from the circuit card and into engagement with a retainer slot in the chassis.

In many instances these conventional circuit card retainers function adequately to lock the circuit card to the chassis. In some instances, when multi-layer circuit cards are used, it is desirable to utilize the maximum amount of circuit card surface on the inner layers of the circuit card. However, the need of riveting these circuit card retainers to the circuit board requires the avoidance of routing circuits in the surface area required for riveting. This restriction reduces the amount of board space that is available on each of the internal layers. In circuit card applications requiring high density circuitry such a restriction may require an increase in board size or additional layers, to accommodate the desired circuit routing, thereby increasing costs.

Normally, these conventional wedge-lock retainers are shipped in an unassembled condition, that is, each of the retainer assembly elements are shipped as discrete parts requiring individual handling and the subsequent assembly of the parts after rivet or screw mounting of the retainer to the circuit card.

Along with the foregoing discrete retainer elements conventional electronic chassis circuit card guides are fabricated as a separate part which is subsequently fastened to the chassis. Here again entailing a parts handling expense.

According to the principles of this invention one embodiment provides a combination circuit card retainer and guide slot for use in an electronic chassis that includes an elongated base member having a circuit card guide wall formed along one side. One end of the base member has a fixed wedge formed thereon spaced from and facing the guide wall. A support aligned with the fixed wedge is formed adjacent the other end of the base member and it is also spaced from the guide wall. The circuit card retainer further includes a shaft having a head end and a thread end. The shaft extends through the fixed wedge with the thread end engaged in an aperture formed in the support. An end wedge is mounted on the shaft adjacent the thread end with a center wedge mounted on the shaft between the fixed and end wedges. The center wedge is provided with a spring that is grounded on the base member for biasing the center wedge into engagement and alignment with the fixed and the end wedges. The aligned wedges together with the guide wall forming a circuit card channel or slot. The circuit card retainer is adapted for mounting to a wall of the electronic chassis.

These and other features, advantages and details of the invention can be had from the following description and claims taken together with the accompanying drawing.

A BRIEF DESCRIPTION OF THE DRAWING

DETAILED DESCRIPTION

Figure 1:
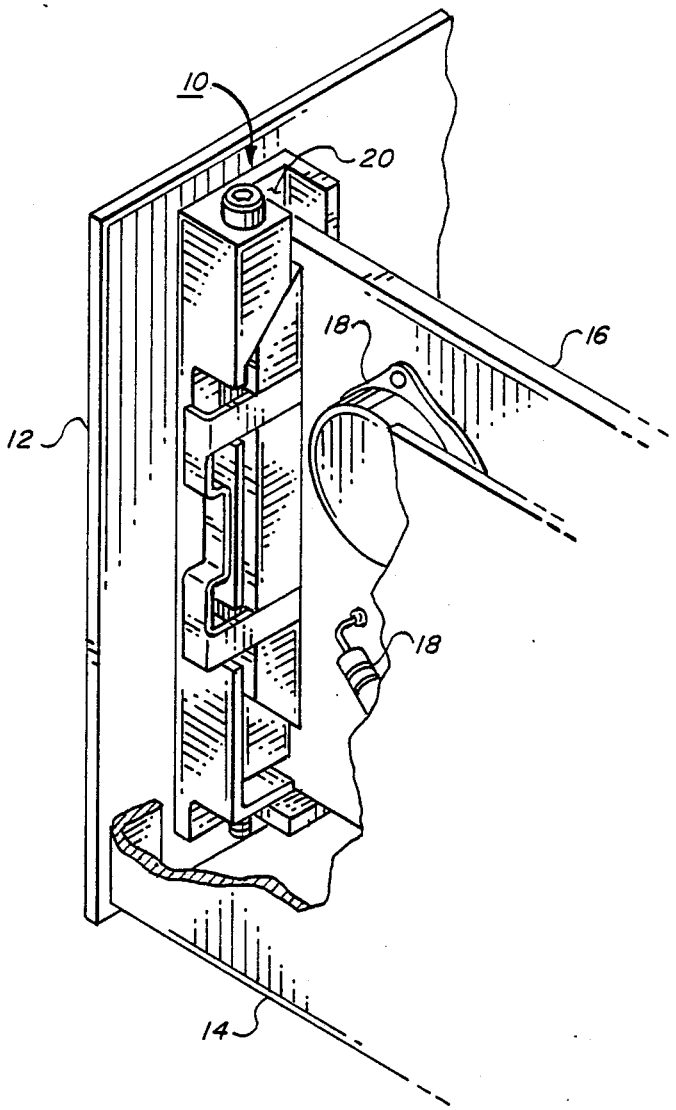
FIG. 1 is a top and side perspective view of an electronic chassis illustrating an embodiment of the invention.

Referring now to the drawing wherein there is illustrated in its various views a more detailed description of the present invention.

A novel circuit card retainer made according to the principles of this invention is generally indicated by reference numeral 10. As illustrated in pair of FIG. 1, retainer 10 is fastened to a sidewall 12 of an electronic chassis 14. It is to be understood that another retainer 10 is fastened to the opposite sidewall of chassis 14, not shown. A circuit card 16 having components 18 mounted thereon is secured within a guide channel 20 formed in retainer 10. Retainer 10 is fastened to sidewall 12 by any suitable means such as, rivets, not shown. Although only one circuit card is illustrated for the sake of clarity, as being mounted in chassis 14 it is to be understood that chassis 14 may be arranged to accommodate more than one circuit card.

Figure 4:
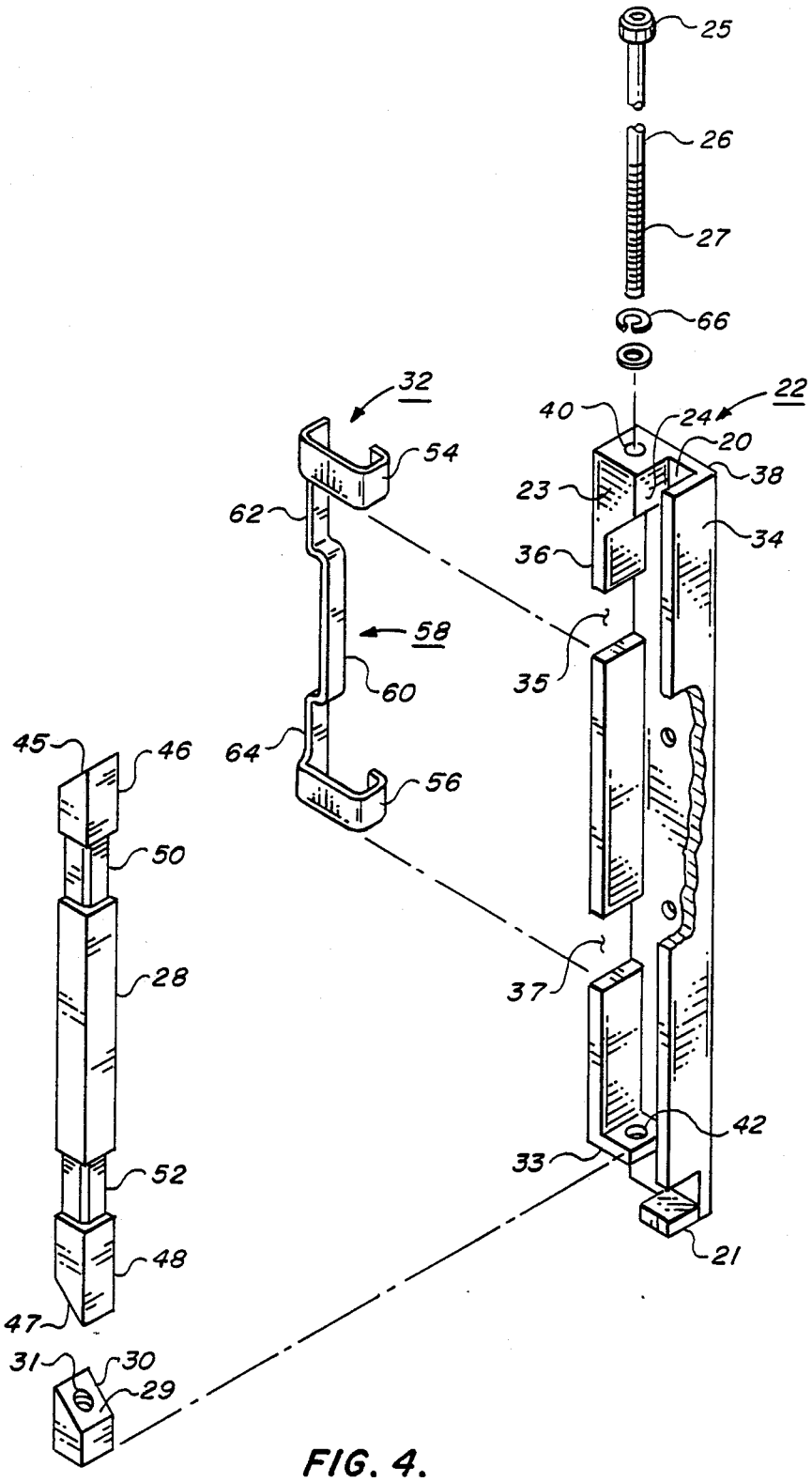
FIG. 4 is an exploded perspective view of the invention shown in FIG. 2.

As illustrated in FIG. 4 retainer 10 includes an elongated base 22, a fixed wedge 24, an elongated shaft 26, a center wedge 28, and end wedge 30 and a bias spring 32.

Shaft 26 is formed with a head end 25 and a threaded end 27. Head end 25 is shown as being formed with an internal hex shaped opening suitable for engagement with a conventional allen-type wrench. However, it is to be understood that the head end 25 can have any arrangement or configuration provides for a convenient means of rotating shaft 26.

As best illustrated in FIG. 4 base 22 is constructed in a generally u-shaped profile. Base 22 includes a guidewall 34 forming one leg of the u-shape, a support wall 36 forming the opposite leg of the u-shape with a bottomwall 38 joining guidewall 34 and support wall 36. Guidewall 34 together with support wall 36 and bottomwall 38 form guide channel 20. Support wall 36 is notched out at 35 and 37 leaving a central support wall section 39 therebetween.

As shown in FIG. 4 one end of support wall 36 is formed as fixed wedge 24 having an aperture 40 extending therethrough. Aperture 40 is sized to provide a clearance fit around shaft 26. A portion of the surface of fixed wedge 24 facing guidewall 34 is formed on the bias to provide an inclined surface 23 as an interface with center wedge 28. The opposite end of support wall 36 is formed as a support bracket 33 having an aperture 42 therein. Aperture 42 is adapted for moveable engagement by threaded end 27 of shaft 26. At the distal end of base 22 a card stop 21 closes off guide channel 20.

Figure 2:
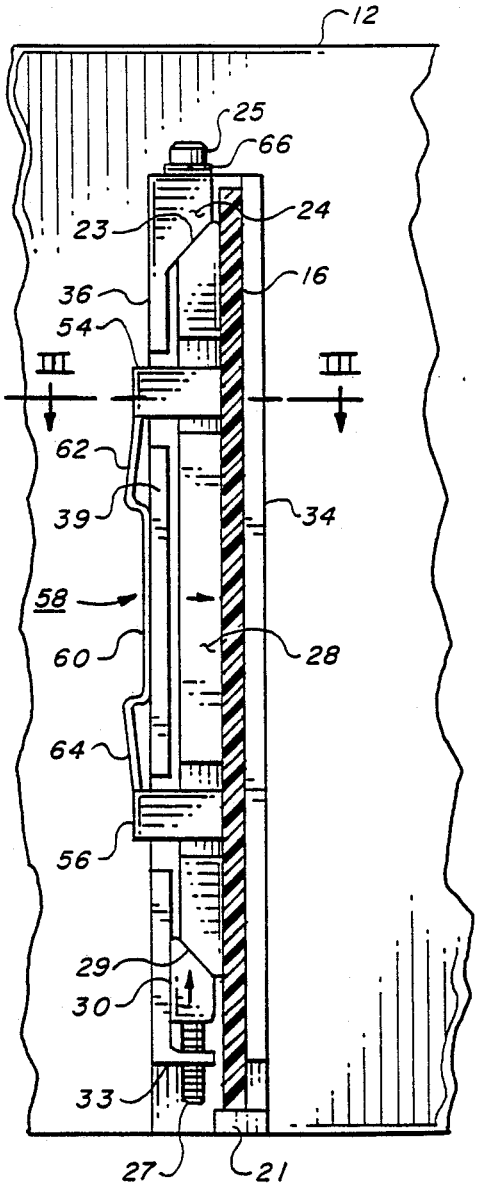
FIG. 2 is a partial view in elevation of the circuit card assembly illustrated in FIG. 1 showing the circuit card assembly fully inserted.

End wedge 30 has one end formed on the bias with respect to its longitudinal axis providing an inclined surface 29 and has an internally threaded aperture 31 which is adapted for threaded engagement with shaft 26. As shown in FIG. 2, end wedge 30 is positioned on shaft 26 adjacent support bracket 33.

Figure 3:
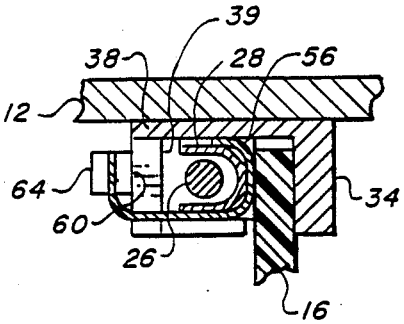
FIG. 3 is a cross-sectional view taken along plane V—V of FIG. 2.

Center wedge 28 has a generally u-shaped cross-sectional configuration as shown best in FIG. 3 allowing center wedge 28 freedom of axial and lateral movement about shaft 26. FIG. 4 shows opposed ends 46 and 48 of center wedge 28 are shaped on a bias with respect to the longitudinal axis of center wedge 28 providing oppositely facing inclined surfaces 45 and 47 on ends 46 and 48 respectively. A pair of recesses 50 and 52 are formed in the outer peripheral surface of center wedge 28. The center of recesses 50 and 52 are spaced approximately one fifth of the length of center wedge 28 from each of the ends 46 and 48, respectively. The depth of the recesses 50 and 52, below the peripheral surface of center wedge 28 is only slightly greater than the material thickness from which bias spring 32 is formed.

Bias spring 32 is formed from a strip of half hard beryllium copper. However, it is to be understood that any spring material that can perform the intended function may be used. As best seen in FIG. 2 bias spring 32 has a pair of c-shaped extensions or legs 54 and 56 which conform to recesses 50 and 52, respectively. Legs 54 and 56 are joined together by a longitudinally extending bias spring strip section 58. Center section 60 lies against central support wall section 39, FIG. 3, thereby biasing center wedge 28 against inclined surface 23 of fixed wedge 24 and inclined surface 29 of end wedge 30. Bias spring 32 also acts to retain and stabilize center wedge 28 about shaft 26.

Prior to use retainer 10 is normally in a relaxed state i.e., shaht 26 is rotated counter-clockwise so that end wedge 30 is sufficiently out of contact with center wedge 28 to permit bias spring 32 to drive center wedge 28 into contact with inside surface of support wall 36 and 39. In this condition center wedge 28 is held clear of guide channel 20.

In the use of retainer 10 a circuit card 16 is inserted into guide channel 20 until the circuit card is seated against card stop 21, FIG. 2. Shaft 26 is rotated so as to draw end wedge 30 into contact with the inclined surface 47 of center wedge 28 and have inclined surface 45 of center wedge 28 cam against inclined surface 23 of fixed wedge 24. As rotation of shaft 26 continues the interaction between inclined surfaces 29 and 47 continues to cam end wedge 30, in the upward direction, as seen in FIG. 2, while at the same time moving center wedge 28 laterally as seen in FIG. 2, toward guidewall 34 and deflecting bias spring 32 to resist the lateral movement of center wedge 28. Rotation of shaft 26 continues until a lock washer 66 under the head of shaft 26 is deflected into its locked position to lock circuit card 16 into intimate heat conducting relationship with guidewall 34.

As will now be understood, the present invention has many advantages in use. One is in providing a combination circuit card retainer that is readily fastened directly to the wall of an electronic chassis thereby freeing additional available space on inner layers of a multi-layered circuit card. Another advantage of the present invention is that the total number of discrete elements requiring handling is reduced in comparison to some conventional circuit card retainers.

A further advantage resides in that the invention is more easily assembled and disassembled than conventional wedge-lock retainers. Conventional retainers require riveting of the center wedge to a circuit card and riveting of a separate guide channel to the chassis sidewall. The invention requires only that the base, item 22, be riveted to the chassis sidewall, thus fastener assembly time and labor is cut in half. This savings is multiplied with each circuit card retained in the chassis. (i.e., 4 cards=4×saving).

A still further advantage is that the invention also allows access to all retainer parts in one area, making assembly and rework easier. All retainer parts are located on the chassis, no handling of static sensitive circuit cards is required to assemble or rework the retainers. With the conventional retainer, parts are located on each individual circuit card thus requiring handling of static sensitive devices in order to assemble or rework the card retainers.

It will be apparent to those skilled in the art that changes may be made to the above described invention without departing from the spirit of the invention and the scope of the appended claims.

What is claimed is:

1. An electronic chassis circuit card retainer comprising:

(a) an elongated base member having a generally u-shaped profile including a guidewall, a support wall spaced from said guidewall and a bottomwall joining said guidewall and said supportwall, (b) a fixed wedge member formed at one end of said support wall, (c) a support bracket formed at an opposite end of said support wall, said support wall including an aperture, (d) a card stop formed at one end of said bottomwall adjacent said support bracket, (e) a shaft extending through said fixed wedge and having a head end and a threaded end, said shaft mounted on said support wall with said head end adjacent said fixed wedge and having said threaded end in engagement with said support bracket, (f) an end wedge member mounted in threaded engagement with said shaft adjacent said support bracket, (g) a center wedge member movably mounted on said shaft between said fixed wedge member and said end wedge member, and (h) a bias spring mounted on said center wedge member or biasing said center wedge member into aligned engagement with said fixed wedge member and said end wedge member.

2. An electronic chassis circuit card retainer comprising:

(a) an elongated base member;

(b) an elongated circuit card guidewall formed along one side of said base member;

(c) a fixed wedge member formed on said base member spaced from said guidewall;

(d) a shaft mounted on said base member and extending through said fixed wedge member and having a head end and a threaded end, said shaft mounted on said base member with said head end adjacent said fixed wedge member;

(e) an end wedge member mounted on said shaft at said threaded end;

(f) a center wedge member, having a generally u-shaped cross sectional configuration, and further having a recess formed in the outer peripheral surface, movably mounted on said shaft between said fixed wedge member and said end wedge member, said center wedge member having freedom of axial and lateral movement about said shaft; and (g) biasing means, mounted on said center wedge member, for biasing said center wedge member into engagement with said fixed wedge member and said end wedge member, and wherein said bias means includes a c-shaped leg which confirms to said center wedge member recess.

3. The circuit card retainer of claim 2 wherein said base member includes a support wall and said bias means includes a bias spring strip section which lies against said support wall.

4. The circuit card retainer of claim 3, wherein said support wall includes a central support wall and said bias spring strip section includes a center section which lies against said central support wall.

5. The circuit card retainer of claim 4 wherein said center wedge member includes oppositely facing inclined surfaces on opposed ends of said center wedge member.

* * * * *